US010974919B2

(12) United States Patent
Patrick et al.

(10) Patent No.: US 10,974,919 B2
(45) Date of Patent: Apr. 13, 2021

(54) DEVICE AND METHOD FOR ALIGNING MATERIAL SHEETS

(71) Applicant: Shark Wheel, Inc., Lake Forest, CA (US)

(72) Inventors: David Michael Patrick, Ladera Ranch, CA (US); Ibra Mesinovich, Lerum (SE); Robert Patrick, Plano, TX (US)

( * ) Notice: Subject to any disclaimer, the term of this patent is extended or adjusted under 35 U.S.C. 154(b) by 0 days.

(21) Appl. No.: 16/536,072

(22) Filed: Aug. 8, 2019

(65) Prior Publication Data

US 2019/0367310 A1 Dec. 5, 2019

Related U.S. Application Data

(63) Continuation-in-part of application No. 16/181,920, filed on Nov. 6, 2018, now Pat. No. 10,688,824, which is a continuation-in-part of application No. 14/953,218, filed on Nov. 27, 2015, now Pat. No. 10,118,439, which is a continuation-in-part of application No. 13/676,790, filed on Nov. 14, 2012, now abandoned.

(51) Int. Cl.
*B65H 23/038* (2006.01)

(52) U.S. Cl.
CPC .... *B65H 23/038* (2013.01); *B65H 2404/1311* (2013.01)

(58) Field of Classification Search
CPC ..... B65H 23/038; B65H 2404/1311
USPC ..... 492/28, 30, 35, 33, 34
See application file for complete search history.

(56) References Cited

U.S. PATENT DOCUMENTS

| | | | |
|---|---|---|---|
| 694,303 | A | 2/1902 | Beskow |
| 740,035 | A | 9/1903 | Nichols |
| 851,055 | A | 4/1907 | Beskow |
| 907,991 | A | 12/1908 | Goodfellow |
| 1,081,844 | A | 12/1913 | Laurencich |

(Continued)

FOREIGN PATENT DOCUMENTS

| | | |
|---|---|---|
| GB | 263965 | 1/1927 |
| JP | 58191603 | 11/1983 |

(Continued)

OTHER PUBLICATIONS

Shark Wheel, Shark Wheel on "Nature Knows Best," Published Nov. 7, 2017, YouTube, https://www.youtube.com/watch?v=OQYsxl0jXGA.

(Continued)

*Primary Examiner* — Jason L Vaughan
(74) *Attorney, Agent, or Firm* — Cionca IP Law P.C.; Marin Cionca

(57) ABSTRACT

A material aligning device having a plurality of sine waves, wherein the sine waves can be in the form of protrusions repeating along an outer surface of a roller. The material aligning device provides an oscillation to the material sheet moving on it to cancel its vibrations, which allows for faster and improved alignment while printing, web converting, and during other similar processes. The material aligning device also relieves the high amount of tension typically necessary for the printing, converting, and other similar material processing using machines. The reduction in tension also reduces the likelihood of the material sheet being overly stretched or for it to rip.

16 Claims, 5 Drawing Sheets

(56) References Cited

U.S. PATENT DOCUMENTS 1,095,445 A * 5/1914 Alvey ..... B65G 39/09 193/37
1,217,919 A * 3/1917 Coryell ..... B21B 1/088 72/221
1,395,734 A 11/1921 Root
1,453,542 A 5/1923 Beisel
1,568,401 A * 1/1926 Griffith ..... D21F 1/36 492/35
1,605,049 A * 11/1926 Maxwell ..... C13B 10/06 492/30
1,749,146 A * 3/1930 Maison ..... F16H 7/18 474/120
1,876,628 A * 9/1932 Dawe ..... B60S 1/68 301/52
2,364,983 A * 12/1944 Lagasse ..... D03J 1/22 139/296
2,372,585 A 3/1945 Klumb et al.
2,618,490 A 11/1952 Frischmann
2,683,495 A 7/1954 Kopczynski
2,786,540 A 3/1957 Sfredda
2,790,503 A 4/1957 Kopczynski
2,819,767 A 1/1958 Kopczynski
2,822,779 A * 2/1958 Schroeder ..... G03G 15/0921 399/277
2,957,410 A * 10/1960 Traphagen ..... B41K 1/12 101/110
2,964,887 A 12/1960 Orozco
3,243,194 A 3/1966 Trusock
3,363,713 A 1/1968 Blonsky
3,456,630 A * 7/1969 Karlan ..... F02B 75/26 123/53.6
3,613,575 A * 10/1971 Kantor ..... B41N 7/06 101/148
3,661,246 A * 5/1972 Faunce ..... B65G 39/071 198/806
3,713,348 A * 1/1973 Conrad ..... F16H 55/36 474/187
3,717,380 A 2/1973 Eastwood, II
3,831,243 A * 8/1974 Conrad ..... F16H 55/34 29/895.211
3,852,910 A 12/1974 Everett
3,860,780 A * 1/1975 Conrad ..... B23K 9/0325 219/76.14
3,870,372 A 3/1975 Knipp
3,972,414 A * 8/1976 Conrad ..... B65G 39/071 198/808
4,047,274 A * 9/1977 Lehmann ..... B22D 11/1287 492/33
4,102,423 A 7/1978 Reid
4,133,371 A 1/1979 Birch et al.
4,272,998 A 6/1981 F'Geppert
4,301,616 A 11/1981 Gudgel
4,674,757 A 6/1987 Martin
4,817,747 A 4/1989 Kopczynski
4,832,186 A * 5/1989 Conrad ..... B65G 39/16 198/806
4,979,406 A 12/1990 Waller
5,070,365 A * 12/1991 Agarwal ..... B65G 39/071 198/843
5,085,010 A * 2/1992 Grau ..... B24B 21/14 451/296
5,096,407 A * 3/1992 Nebeling ..... B31F 1/2845 156/470
5,213,202 A * 5/1993 Arnold ..... A01F 15/18 198/835
5,259,802 A 11/1993 Yang
5,593,366 A * 1/1997 Puzik ..... F16H 7/02 474/177
5,601,491 A 2/1997 Chan et al.
5,881,831 A 3/1999 Harvey
5,934,441 A * 8/1999 Uchida ..... B65G 47/54 198/370.01
6,120,356 A 9/2000 Jaskowiak et al.
6,227,622 B1 5/2001 Roderick et al.
6,244,937 B1 6/2001 Jaskowiak et al.
6,358,133 B1 3/2002 Cesena et al.
6,402,342 B1 6/2002 Chiang
7,090,057 B2 8/2006 Fryska et al.
7,128,175 B1 10/2006 Martineau
D541,047 S 4/2007 Moon
7,311,318 B1 12/2007 Funk
D576,795 S 9/2008 Moon
7,749,033 B1 7/2010 Paulus
7,803,031 B1 9/2010 Winckler et al.
8,002,294 B2 8/2011 Brandeau
3,020,679 A1 9/2011 Wu
D703,442 S 4/2014 Parker
D718,938 S 12/2014 Parker
D732,293 S 7/2015 Parker et al.
D775,283 S 12/2016 Parsley
10,118,439 B1 11/2018 Patrick
2005/0116539 A1 6/2005 Jiazheng
2008/0125001 A1 5/2008 Barniak
2009/0243371 A1 10/2009 Karlsson
2011/0203708 A1 8/2011 Karlsson
2011/0233991 A1 9/2011 Norman
2013/0337104 A1 12/2013 Vannarsdall
2014/0132059 A1 5/2014 Patrick
2014/0175350 A1 6/2014 Mariotti
2015/0298501 A1 10/2015 Engel

FOREIGN PATENT DOCUMENTS

RU 2438879 1/2012
WO 2016048880 3/2016

OTHER PUBLICATIONS

Wikipedia, "Shark Wheel," Published Jan. 2, 2018, https://en.wikipedia.org/wiki/Shark_Wheel.
Kickstarter Campaign, "Shark Wheel—the Square Skateboarding Wheel that Shat Shreds!," Published Jun. 2013, https://www.kickstarter.com/projects/1537100752/shark-wheel-the-square-skateboarding-wheel-that-sh/description.

* cited by examiner

FIG. 1 – Prior Art

DEVICE AND METHOD FOR ALIGNING MATERIAL SHEETS

CROSS-REFERENCE TO RELATED APPLICATIONS

This application is a continuation-in-part and claims the benefit of U.S. Non-Provisional application Ser. No. 16/181,920, filed Nov. 6, 2018, which is a continuation-in-part application and claims the benefit of U.S. Non-Provisional application Ser. No. 14/953,218, filed Nov. 27, 2015, now U.S. Pat. No. 10,118,439, which is a continuation-in-part and claims the benefit of U.S. Non-Provisional application Ser. No. 13/676,790, filed Nov. 14, 2012, which are hereby incorporated by reference, to the extent that they are not conflicting with the present application.

BACKGROUND OF INVENTION

1. Field of the Invention

The invention relates generally to rollers, and more specifically to rollers having a sinusoidal layer for enhancing alignment of material sheets in machines that use, handle or process material sheets that roll on rollers.

2. Description of the Related Art

As an example, the printing, conveyor, and converting industries utilize rollers for guiding material sheets through the machines and systems they use. However, these rollers often do not keep the material sheets as aligned or centered as necessary for the machine to perform well or for the material sheet to be processed at a high quality or handled with high accuracy. As an example, web converters, industrial printing machines, and belt/roller conveyors cause miniature vibrations during their handling processes due to the many moving components of the system. However, these miniature vibrations cause many issues for printing, web converting, and other material handling or processing applications. As an example, in printing and converting applications, these vibrations cause misalignment of the printed text and misalignment of the finished web rolls, respectively. In another example, in the context of belt conveyors, misalignment of the belt on the rollers can cause faster wearing of the belt.

Currently, attempts are made to counteract these vibrations by tension being applied to the sheet of material. Tension is applied by stretching the printing paper and webbing medium for example, but this can cause issues, such as printing quality issues or other material issues such as for the material to rip.

Further, in most of these machines, the contact between the material sheet and roller(s) have a high amount of friction between them, which is typically amplified by tension being applied, and that may also contribute to the possibility of ripping the material. In an example, the entire process performed by the machines is slowed down due to high friction and tension needed for centering the tensioned materials. Therefore, there is a need to solve the problems described above by proving a device and method for efficient and more accurate printing, web converting, and other material handling or processing applications in which centering the material while in motion is important.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a material centering device that limits the effects of vibrations or other misalignment causes during the printing, converting, or other material handling or processing applications is provided, the device having a sinusoidal layer associated with rollers on which the material runs. The sinusoidal layer enables oscillations that allow for better alignment and less slippage off of the roller even with decreased amount of tension. Thus, an advantage is more precise printing, converting, or other material handling or processing applications. Another advantage is not needing to use a high amount of tension, which can cause undesirable stretching and even ripping of the material.

In another aspect, the material centering device allows for a decrease in friction because of the minimized contact between the roller and the sheets of material due to the sheets of material being able to rest on the sinusoidal protrusions of the device alone. This decrease in friction allows for the machines to run (e.g., print) faster. Thus, an advantage is the increase of speed, making the jobs more time efficient, which leads to an increase of profitability.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
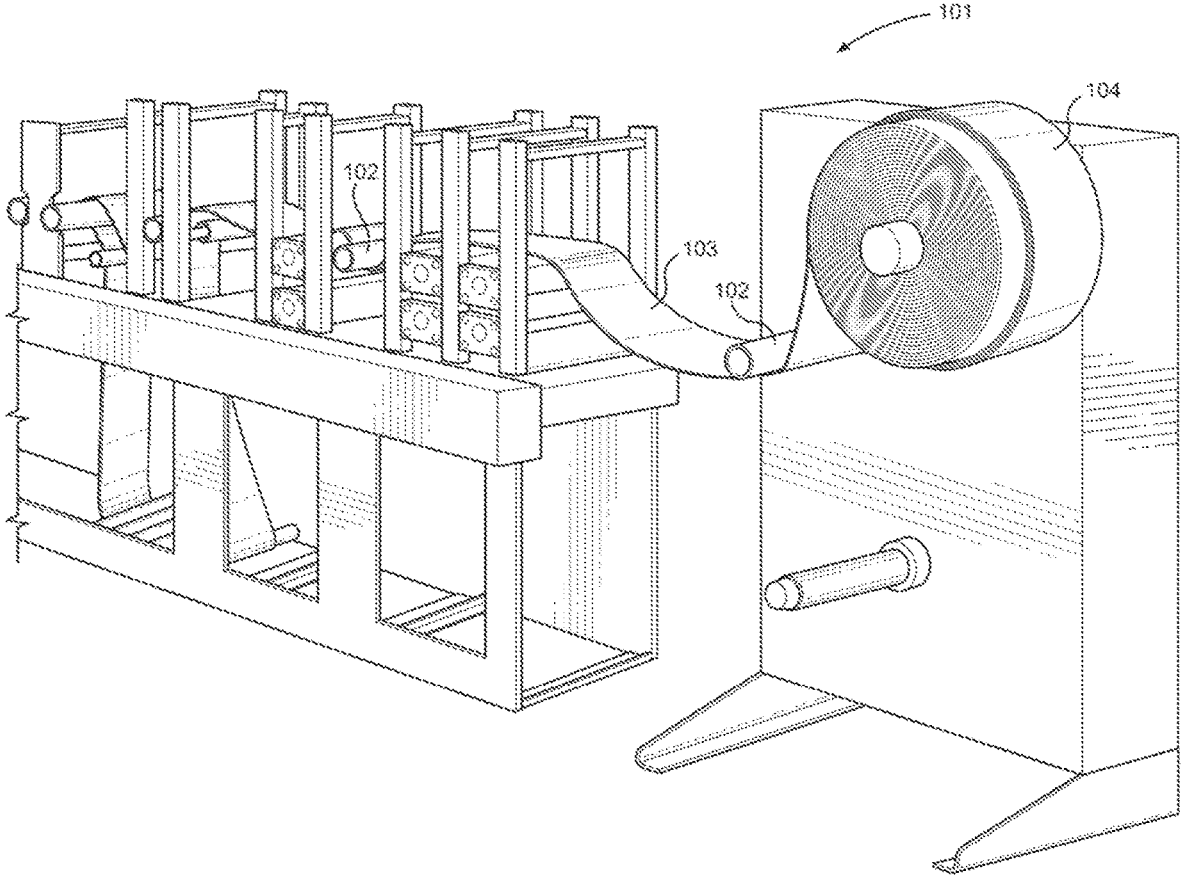
FIG. 1 is a perspective view of a prior art printing machine.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 102 and 202, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 is a view of a prior art printing or web converting machine 101 that utilizes rollers 102 for moving the paper, or rolling sheet of material, 103 through the machine 101. As an example, the printing, conveyor, and converting industries utilize rollers 102 for guiding material sheets through the machines and systems they use, process or handle. However, these rollers 102 often do not keep the material sheets as aligned or centered as necessary for the machine to perform well or for the material sheet to be processed, used or handled at a high quality or with high accuracy.

As shown in FIG. 1, rollers 102 can be used as retraction rollers which are used to help the materials change direction while running through the machine. As shown, the paper 103 is being pulled off the larger paper roll 104 and is running in an under and over pattern, alternating from each of the adjacent rollers 102 to be fed through the printer 101. The rollers 102 may also be used as tension rods for holding and stretching the sheet of material 103 to for example limit the effects of the vibrations.

In a printing context, this tension may be necessary for alignment and printing precision because, without the rolling sheet of material 103 being pulled tight in tension, the miniature vibrations cause ghosting, which is when the printed words are layered or look like each letter has a shadow. However, the large amounts of tension that are needed to subdue these effects may cause the rolling sheet of material 103 to be undesirably stretched out or possibly rip. The rollers 102 also may cause high amounts of friction between its surface and the rolling sheet of material 103 because of the full contact between the surface of the rollers 102 and the paper 103, which contributes to the possibility of ripping. This friction is further exacerbated by the high tension within the material sheet 103.

Figure 2:
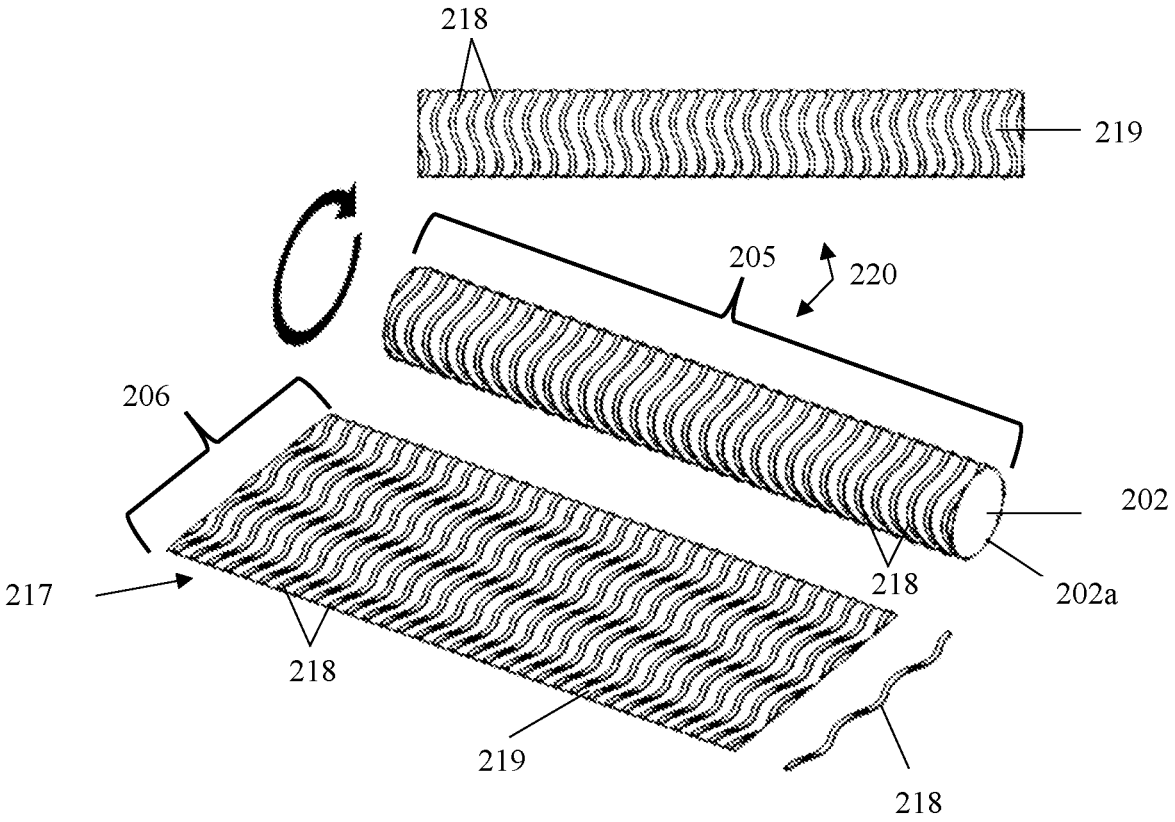
FIG. 2 illustrates perspective and plan views of a sinusoidal layer, according to an aspect.

FIG. 2 illustrates perspective and plan views of the sinusoidal layer 217, according to an aspect. As shown, the repeating pattern may be a sine wave running the width 206 of a base layer 219, with the sine wave repeating throughout the length 205 of the base layer 219. The sinusoidal waves 218 may be embedded, attached to, or otherwise associated with the roller 202, to improve the centering of the material sheets, as described herein. As shown, in an example, the width 206 and length 205 of the sinusoidal layer 217 corresponds preferably to the circumference and length, respectively, of roller 202, such that when the sinusoidal layer 217 is associated with the roller 202, the entire surface of the roller 202 extending over length 205 is covered by sine waves 218.

As shown, the sine waves (e.g., sinusoidal protrusions) 218 may be uniformly spaced and may be attached to the base layer 219. The sinusoidal layer 217 may have sine waves 218 running parallel to each other along, for example, the entire length 205 of the top surface of the base layer 219. It should be noted that a base layer 219 is not always needed, such as when the sine waves 218 are machined into the rollers 202 or otherwise (e.g., by mold casting) made integral to the rollers 202.

It should be observed that, when the sine waves 218 are sinusoidal protrusions (see e.g., FIGS. 3*a-d*), they provide support points for the rolling sheet of material 103 to rest on, allowing for a decrease in friction during the printing, handling, or converting process, since the material sheet 103 does not rest on the entire surface of roller 102.

The roller 202 is shown with the sinusoidal layer 217 wrapped around it. Again, the sinusoidal layer 217 may have sine waves 218 that are parallel to one another with the peak of one sine wave being parallel to the peak of an adjacent sine wave, and so on, as shown in FIG. 2.

It should be understood that, instead of sine wave shapes, other similar shapes could possibly be used, such as alternating arches.

It should also be understood that the sinusoidal "layer" may be implemented in various ways, such as in the form of an adhesive tape or a sleeve attached to the roller 202, or, an integrated machined or casted layer.

In an example, the base layer 219 can be made up of a top and bottom surface, with each surface having adhesive to allow the bottom surface to be adhered to the rollers 202, and the different sine waves 218 and 408 configurations adhered to the top side of the base layer 219. The base layer 219 is formable for allowing it to wrap around and thus enhance the rollers 202 that are currently being used. In another example, the sine waves 218 may be integral to the base layer 219.

In another example, a sleeve 202*a*, having the sine waves 218, can be used to associate the sine waves 218 to rollers 202.

It should be understood that irrespective of the method of association of the sine waves 218 to the rollers 202, the sine waves 218 could be used to cover only a portion of the rollers 202, such as for example covering a central portion of the roller 202 or a pair of portions, one on one end of the roller 202 and one on the opposing end of the roller 202.

It should be noted that, preferably, the rolling sheet of material 103 would run "parallel" to the sine waves 218 (i.e., paper 103 moving forward in FIG. 1 and rollers 102, and thus the sine waves 218 once they are attached to rollers 102, in a counter clock direction). This allows the material sheet 103 to continuously oscillate (left and right, when referring to FIGS. 1 and 2), while the material sheet 103 is moving through the multitude of rollers 220 having the sine waves 218.

It is believed that this back and forth (i.e., left and right, when referring to FIGS. 1 and 2), oscillations caused by the sine waves 218 counteract the resulting vibrations of the machines and that the canceling of vibrations also allows the paper to have better center alignment (i.e., to stay centered on the rollers 220), which allows for more precision when printing and converting, for example. It is believed this is possibly due to Newton's first law which states that an object will stay at rest or in uniform motion unless acted upon by an outside force. It is also believed that the rolling sheet of material 103 wants to move straight, but the miniature vibrations of the system disrupts the linear path of the material sheets and the oscillations that the sine waves 218 provide allow for the material to transversally travel (i.e., left and right, when referring to FIGS. 1 and 2), to negate the effects of the miniature vibrations and provide a more aligned end result.

This sinusoidal layer 217 has the ability to be applied to any roller making the process to begin utilizing the layer more efficient. In an example, the sinusoidal layer 217 would be attached around the roller in the printer, converter, or conveyor and then the machine would be used as it typically is. The user would feed the material sheet 103 through the wrapped roller 202 and then begin the material processing at a lessened tension and a higher speed because of the benefits of the sinusoidal layer 217. Again, the sine waves 218 may preferably repeat over the length 205 of the roller 202 or sleeve 202*a*.

Again, in another example, the sinusoidal layer 217 may be integral to the roller 202. This may be achieved for example by machining the protrusions onto the roller. It can also be achieved by casting the part with the protrusions 218. This allows the existing roller without any protrusions to be replaced by a roller with sinusoidal protrusions 218, which provides the benefits as previously described. The cylinder, or roller with protrusions 202 may be installed into the machines 101 and begin centering the material sheets 103.

Figure 3A:
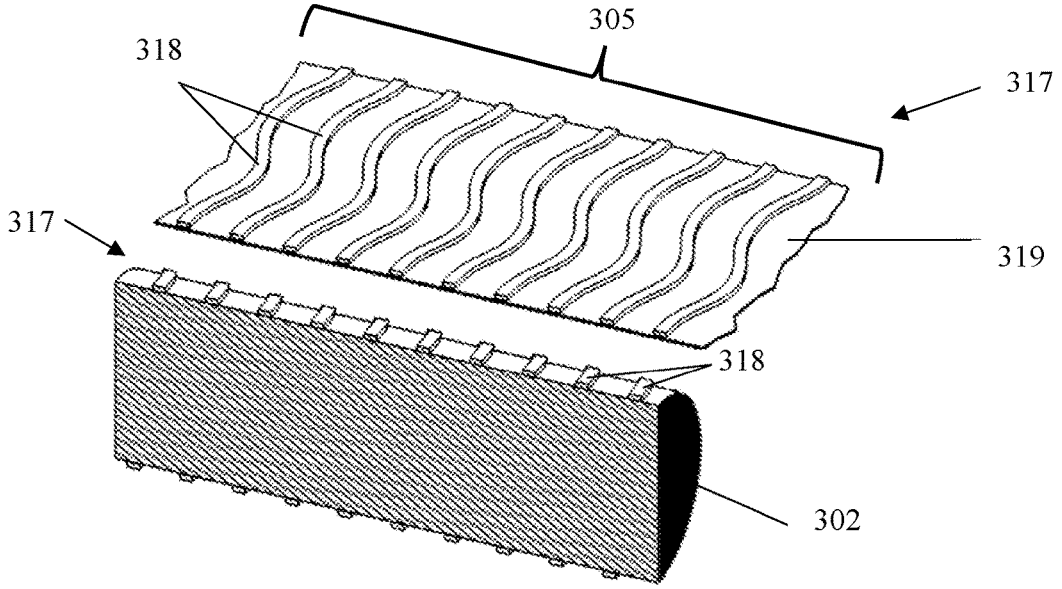
FIGS. 3*a*-3*d* illustrate perspective and cross-sectional views of the sinusoidal layer, according to an aspect.

FIG. 3*a* illustrates a perspective cross section view of the sinusoidal layer 317 prior to being wrapped around the roller 302. Also shown in FIG. 3*a* is a cross-section of roller 302 showing the sinusoidal layer 317 wrapped around the roller 302. As shown in the cross-sectional view of the sinusoidal layer 317 the repeating protrusions 318 are visible along with their protrusion gaps 313. The base layer 319 is also visible and, again, when used, it may have adhesive on both the top and bottom surfaces allowing for the repeating protrusions 318 to be associated with the surface, while also having adhesive on the opposing side for attaching to the roller 302. The sinusoidal layer 317 with adhesive on its surfaces may be used as a tape to easily be applied to the existing rollers in existing machines and thus enhance their performance, as described herein.

As shown in the cross-section view of FIG. 3*a*, the sinusoidal layer 317 may be integral to the roller 302. The protrusions 318 may be machined or casted into the roller 302, which would allow the user to replace the current rollers 102 with rollers 302 having the sine wave protrusions 318.

The protrusions 318 may also be integral or attached to a sleeve (202*a* in FIG. 2) that may be applied to the existing rollers 302. The sleeve may be stretched to fit onto the roller 302 but would be snug on the roller 302 so it would not come off. The tightness of the sleeve would allow for a high amount of friction between the roller 302 and the sleeve to ensure a strong connection. To further ensure a strong connection, the sleeve 202*a* may have a layer of adhesive on its interior for attaching to the roller 302.

Figure 3B:
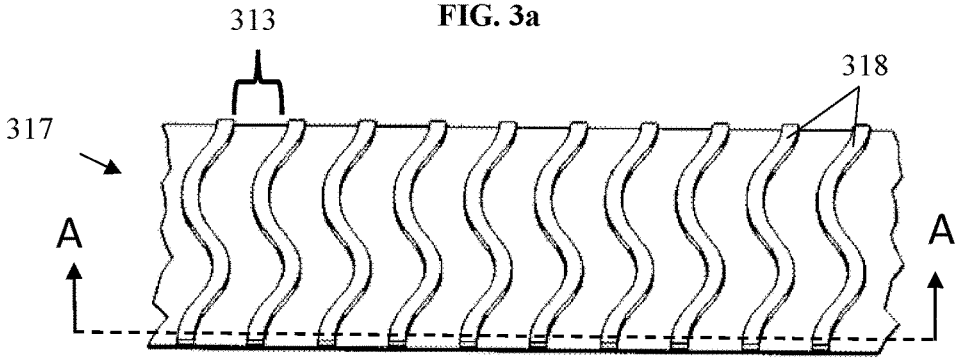

FIG. 3*b* illustrates a perspective top view of the sinusoidal layer 317 further showing a single repeating pattern, as an example. The repeating protrusions 318 may repeat to provide a uniform gap 313 in between each protrusion 318. This gap 313 minimizes the friction between the material sheet 103 and the roller due to the material sheet 103 being able to rest exclusively on the protrusions 318.

Figure 3C:
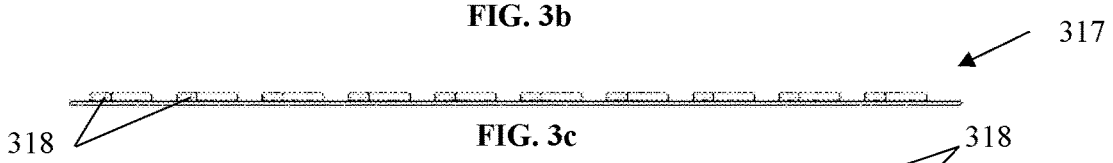

FIG. 3*c* illustrates a leveled cross section view of the section A-A from FIG. 3*b*, where the sinusoidal layer 317 is lying flat. This sinusoidal layer 317 may be applied to printing machine and web converter retraction rollers, and other rollers (e.g., conveyor belt rollers) to help the sheets of material 103 to stay centered. The sinusoidal layer 317 may be applied to these rollers 302, making the protrusions 318 repeat lengthwise 305 over the roller 302.

Figure 3D:
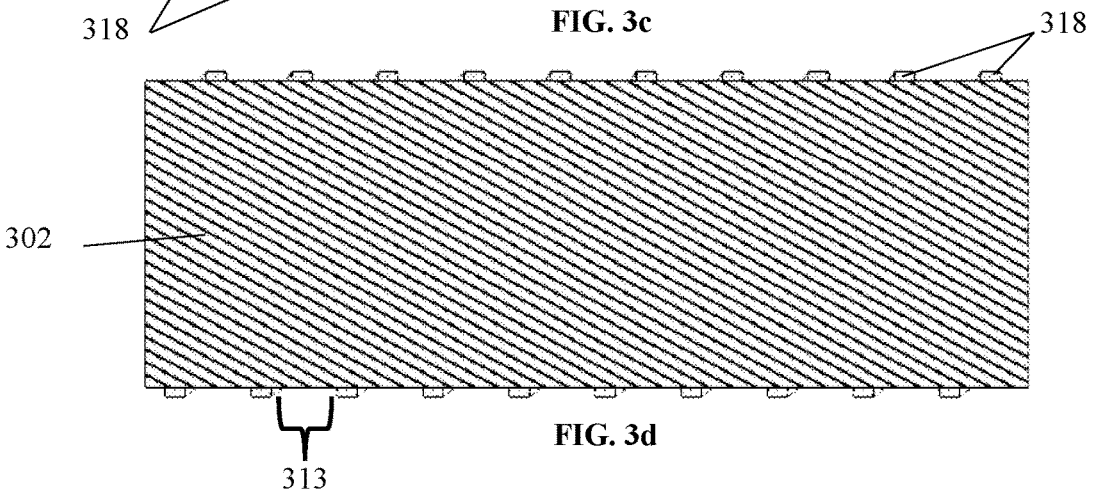

FIG. 3*d* illustrates a cross section view of the sinusoidal layer 317 associated with the roller 302. As shown in the cross-sectional view of the sinusoidal layer 317, the repeating protrusions 318 are visible as they protrude from the base layer 319. These repeating protrusions 318 protrude from the base layer 319 forming the previously described uniformed gaps 313. In an example, these protrusions 318 are small enough where they do not interfere with the machine's design or capability, rather, they enhance the dynamics of the system.

This sinusoidal protrusion layers 317 may be applied to rollers 302 in these applications to help align paper in a printing machine or other types of web in a converter. In another example, the material sheets may be a belt in a conveyor belt. The apparatus disclosed herein can be used in other similar applications in which the moving materials need to stay centered within the running machines.

Figure 4:
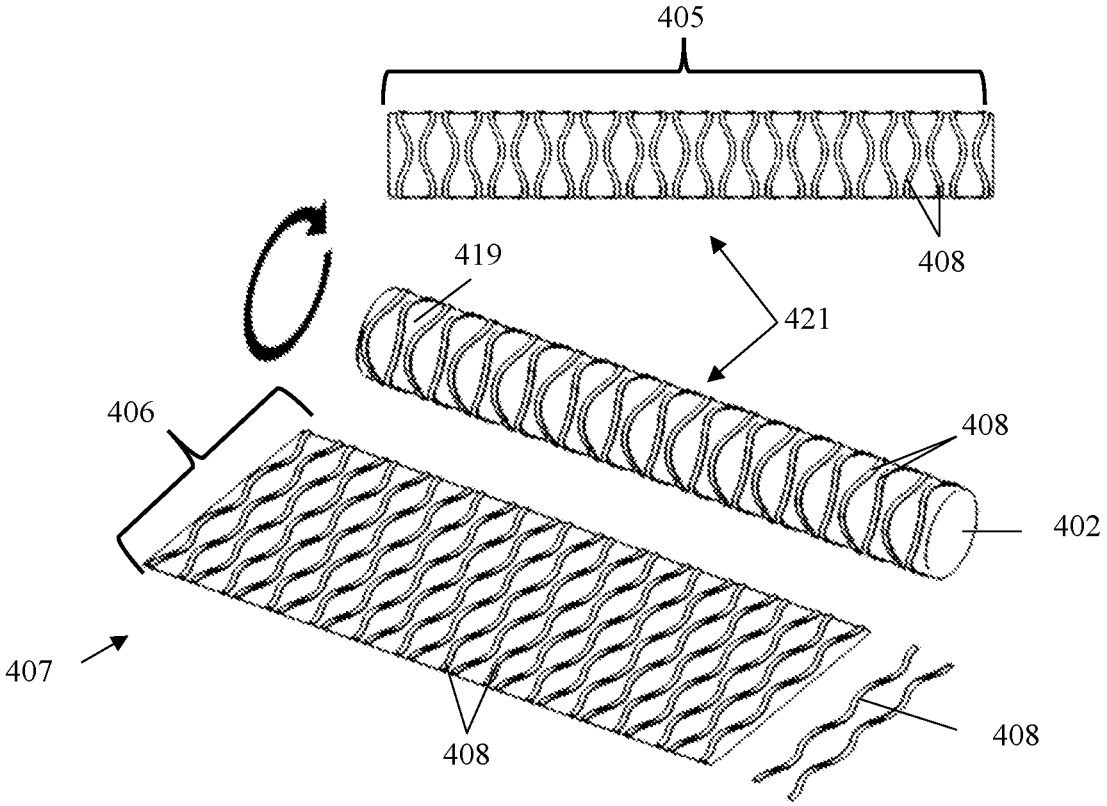
FIG. 4 illustrates perspective and plan views of a sinusoidal layer with an opposing pattern, according to an aspect.

FIG. 4 illustrates perspective views of the sinusoidal layer 407, according to an aspect. As shown, the sinusoidal layer 407 may be in an opposing sinusoidal, or DNA, shape. The pattern may be composed of pairs of two opposing sine waves 408, creating a two-dimensional double helix (DNA) shape, as shown in FIG. 4. The opposing sine waves 408 may run the width 406 of the base layer 419 and with the double helix repeating throughout the length 405 of the base layer 419. These opposing protrusions 408 may be attached or integral to the base layer 419. The opposing protrusions 408 are support points for the rolling sheet of material 103 to rest on allowing for a decrease in friction during the material handling process. The sinusoidal layer 407 has sinusoidal protrusions 408 that are opposite of one another, as shown in FIG. 4, with the peak of one sine wave mirroring the peak of an adjacent sine wave.

It should be understood that this sinusoidal layer in the opposing wave pattern may be an adhesive tape, sleeve, or machined or casted protrusions, but could also be done by other similar means.

The roller 402 is shown in FIG. 4 with the sinusoidal layer 407 wrapped around its exterior surface. This sinusoidal layer 407 has the ability to be applied to any existing roller making the process to begin utilizing the advantage of the sinusoidal layer 407 possibly more efficient. In an example, the sinusoidal layer 407 would need to be wrapped around the roller 102 in the printer 101, converter, conveyor, etc., and then the machine would be used as it typically is. The sinusoidal layer 407 may be in the form of an adhesive tape, a sleeve, or the sinusoidal protrusions may be integral to the roller 402 by a casting, machining or other similar techniques or processes. It is believed that with the sinusoidal protrusions attached to the roller 402 the user would feed the rolling sheet of material 103 through the wrapped rollers 421 and begin the material processing at a lessened tension and a higher speed because of the mentioned benefits of the sinusoidal layer 407. The opposing protrusions 408 may also be integral to the base layer 419.

In an example, as with the sinusoidal roller 202 from FIG. 2, the rolling sheet of material 103 would run parallel to the sinusoidal protrusions 408, allowing for the material sheet 103 to continuously oscillate on each wrapped roller 421 while the rolling sheet of material 103 is moving through the multitude of wrapped roller 421. It is believed that this back and forth oscillation counteract the vibrations caused by the machine. It is also believed that the canceling of vibrations also allows the rolling sheet of material 103 to have better center alignment on rollers, which allows for more precision when printing, converting, or in other similar applications.

In another example, the sinusoidal layer 407 may be integral to the roller 421. This may be achieved for example by machining the protrusions onto the cylinder. It can also be achieved by casting or other similar processes. This allows the existing roller 402 without any protrusions to be replaced by a roller with sinusoidal protrusions 408 in an opposing pattern, which provides the benefits as previously described. The sinusoidal protrusions 408 may repeat over the length 405 of the roller or sleeve 402.

Figure 5A:
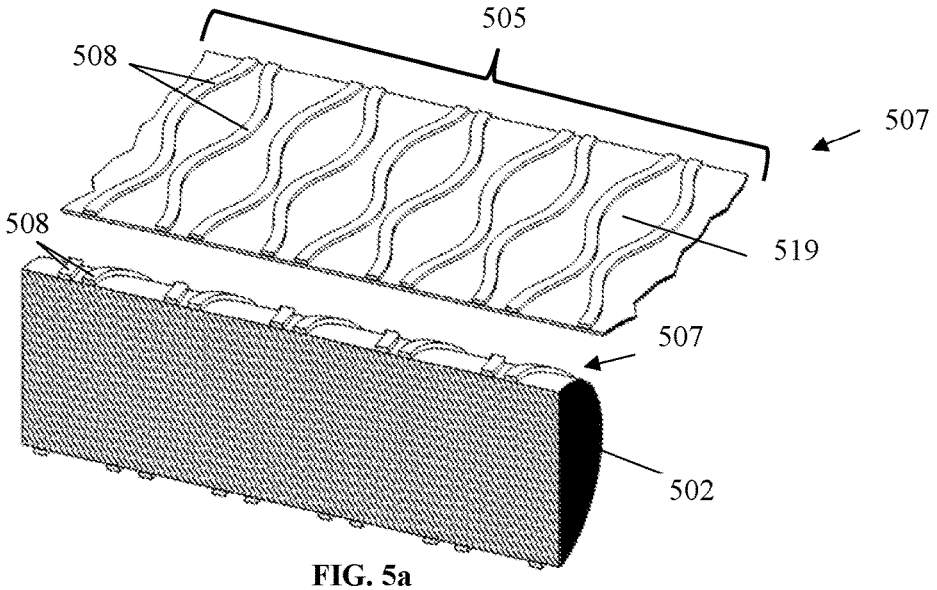
FIGS. 5*a*-5*d* illustrate perspective and cross-sectional views of the sinusoidal layer with an opposing pattern, according to an aspect.

FIG. 5*a* illustrates a perspective cross section view of the sinusoidal layer 507 prior to being wrapped around the roller 502. Also shown in FIG. 5*a* is the sinusoidal layer 507 wrapped around the roller 502. In an example, the base layer 519 has adhesive on both the top and bottom surfaces allowing for the opposing protrusions 508 to stick to the surface, while also having adhesive on the opposing side for attaching to the roller 502.

As shown in the cross-section view of FIG. 5*a*, the sinusoidal layer 507 may be integral to the roller 502. The protrusions 508 may be machined or casted into the roller, which would allow the user to replace the current rollers 502 with ones with the sine wave protrusions 508. The protrusions 508 may also be integral to a sleeve that may be applied to the existing rollers in the system. The sleeve may be stretched to fit onto the roller 502 but would be snug on the roller 502 so it would not come off. The tightness of the sleeve would allow for a high amount of friction between the roller 502 and the sleeve, another way to ensure a strong connection would be having a layer of adhesive on the interior of the sleeve. The sinusoidal layer 507 may be applied to these rollers 502, making the protrusions 508 repeat lengthwise 505 over the roller 502.

Figure 5B:
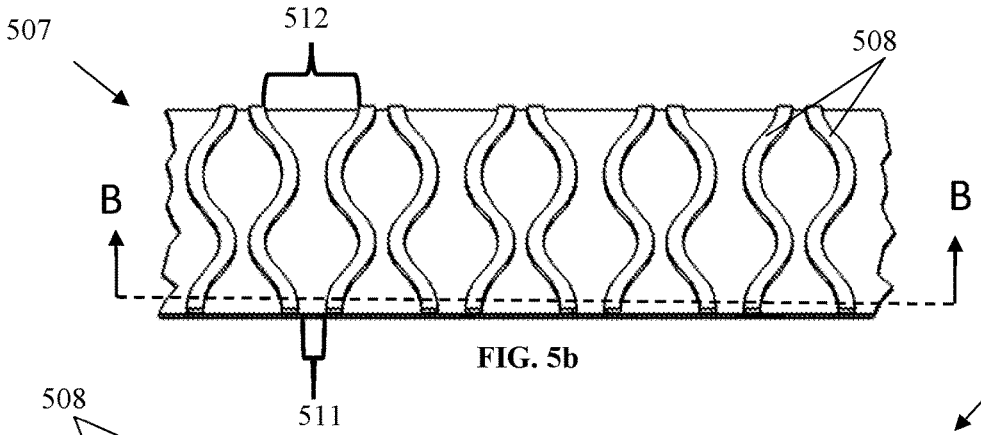
Figure 5C:
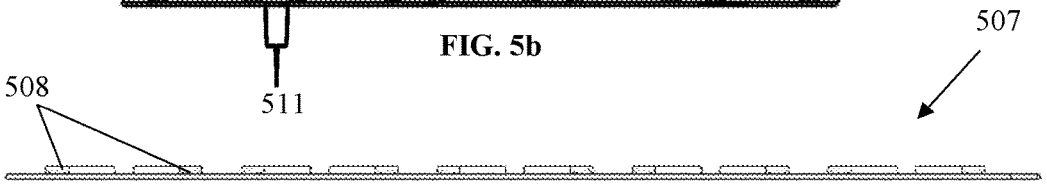
Figure 5D:
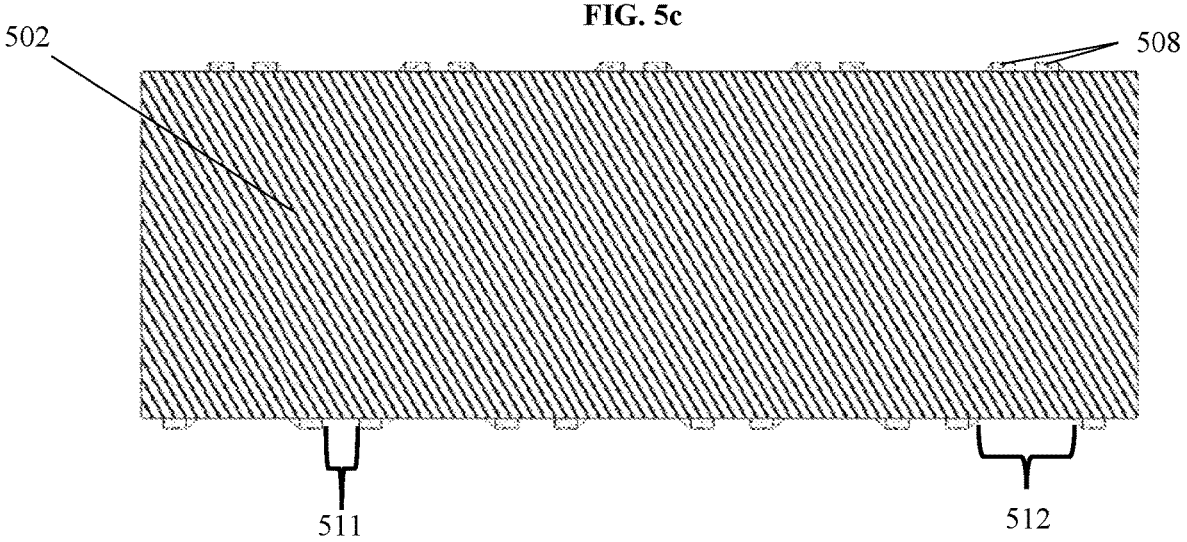

FIG. 5*b* illustrates a top view of the sinusoidal layer 507 further showing the opposing pattern. As shown, due to the opposing arrangement of the protrusions 508 an alternating narrow 511 and wide gap 512 pattern is obtained. FIG. 5*c* illustrates a cross section view of the section B-B from FIG. 5*b* where the sinusoidal layer 507 is lying flat. FIG. 5*d* illustrates a cross section view of the sinusoidal layer 507 on the roller 502. As shown in the cross-sectional view of the sinusoidal layer 507, the opposing protrusions 508 are visible. As shown, these protrusions 508 are small enough, where they do not interfere with the machine's design or capability, rather, they enhance the dynamics of the system, as described herein.

In another example, the sinusoidal layer 507 can be applied to the belt conveyor system by a sleeve over the rollers 502 in the system. The protrusions 508 may be integral to a sleeve and the sleeve may be placed on the existing rollers 502. The sleeve may be stretchable to produce friction while on the existing roller 502 to allow the sleeve to stay in place while the machine is running. The sinusoidal sleeve may also have an adhesive layer on the interior to further ensure a strong connection between the sinusoidal sleeve and the roller 502 or cylinder.

This sinusoidal protrusion layer 508 in the opposing pattern may be applied to rollers 502 in these applications to help align paper in a printing machine, other types of web in a converter, and in another example the material sheets may be a belt in a conveyor belt. All the previous mentioned applications need the moving materials to stay centered within the running machines.

As indicated herein, it is preferred to have the sine waves be raised (protrusions) because of the resulting reduced amount of friction between the material and the roller, while the sine waves provide the desired material sheet centering effect. However, it should be understood that other approaches may possibly work comparably well, such as when the sine waves would be flush with the roller, but the sine waves would be made from a high friction material, such as rubber, while the remaining portions of the roller are made of a low friction material, such as a highly polished steel.

It may be advantageous to set forth definitions of certain words and phrases used in this patent document. The term "material sheet" should be understood broadly to include material sheets that can be flat on one side, two sides (e.g., a paper sheet) or none of the sides; further, they can be thin (e.g., paper sheet) or thick (e.g., a conveyor belt) and not necessarily of a rectangular cross-section; as long as they have a portion of one side forming a substantially flat surface that can roll on a roller, it is a material sheet for the purpose of this application. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A printing machine comprising:

a roller for guiding a printing material sheet having an exterior surface;

a tape having a plurality of protrusions, the tape being disposed on the exterior surface and adjacent to each other, wherein each of the plurality of protrusions is a sine wave and form a closed loop around the exterior surface;

wherein the plurality of protrusions extends over the entire length of the roller; and during a process of printing on the printing material sheet being thus adapted to center the printing material sheet by oscillating the printing material sheet left and right as the printing material sheet moves forward through the printing machine.

2. The printing machine of claim 1, wherein the plurality of protrusions is integral to the tape.

3. The printing machine of claim 1, wherein the plurality of protrusions is disposed lengthwise over the exterior surface and each protrusion is parallel to each other.

4. The printing machine of claim 1, wherein the plurality of protrusions is disposed at equal distance between protrusions.

5. The printing machine of claim 4, wherein the protrusions are repeated throughout the length of the tape.

6. The material sheet aligning device of claim 1, wherein the protrusions are parallel to each other.

7. The printing machine of claim 1, wherein the protrusions are opposed to each other.

8. A printing machine comprising:

a roller; and a sleeve having a base layer, the sleeve being adapted to cover the roller, and a plurality of protrusions, wherein each of the plurality of protrusions is in the shape of a sine wave and is disposed on the base layer;

wherein the sleeve is adapted to have the plurality of protrusions form a closed loop when covering the roller.

9. The printing machine of claim 8, wherein the sleeve is formed from a tape.

10. The printing machine of claim 8, wherein the plurality of protrusions is integral to the sleeve.

11. The printing machine of claim 8, wherein the plurality of protrusions is disposed lengthwise and in parallel to each other over the sleeve.

12. A printing machine comprising: a roller having a plurality of protrusions, wherein the plurality of protrusions is associated with the roller and repeated over the roller;

wherein each of the plurality of protrusions has a sine wave shape; and the printing machine being thus adapted to center a printing material sheet during a process of printing the printing material sheet.

13. The printing machine of claim 12, wherein the plurality of protrusions is disposed lengthwise and in parallel over the roller.

14. The printing machine of claim 12, wherein the plurality of protrusions is integral to the roller.

15. A method of centering a printing material sheet, the method comprising:

adapting a roller to have a sinusoidal layer, wherein the sinusoidal layer comprises a plurality of sinusoidal protrusions;

causing the moving printing material sheet to roll over the sinusoidal layer of the roller thereby centering the moving printing material sheet for precise printing by oscillating the moving material sheet left and right as the moving material sheet continues forward.

16. The method of claim 15, wherein the moving printing material sheet is a web paper sheet.

* * * * *